US006243127B1

(12) United States Patent
Burberry et al.

(10) Patent No.: US 6,243,127 B1
(45) Date of Patent: Jun. 5, 2001

(54) PROCESS OF FORMING AN IMAGE USING A MULTILAYER METAL COALESCENCE THERMAL RECORDING ELEMENT

(75) Inventors: Mitchell S. Burberry; Lee W. Tutt; Robert G. Spahn, all of Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/055,138

(22) Filed: Apr. 3, 1998

(51) Int. Cl.[7] ..... B41J 2/435
(52) U.S. Cl. ..... 347/262; 347/264
(58) Field of Search ..... 347/262, 264; 346/135.1; 428/458, 461, 270.12, 536, 524, 463; 430/270.12, 536, 524

(56) References Cited

U.S. PATENT DOCUMENTS

| | | | | |
|---|---|---|---|---|
| 4,309,713 | * | 1/1982 | Shinozaki et al. | 346/135.1 |
| 4,394,661 | | 7/1983 | Peeters | 346/1.1 |
| 4,499,178 | * | 2/1985 | Wada et al. | 430/495 |
| 4,650,742 | | 3/1987 | Goto et al. | 430/271 |
| 5,742,401 | * | 4/1998 | Bringley et al. | 358/297 |
| 6,033,839 | * | 3/2000 | Smith et al. | 430/496 |

* cited by examiner

*Primary Examiner*—John Barlow
*Assistant Examiner*—Manish S. Shah
(74) *Attorney, Agent, or Firm*—Harold E. Cole

(57) ABSTRACT

A process of forming an image comprising imagewise-exposing, by means of a laser, a thermal recording element comprising a transparent support having thereon at least two metal layers having a melting point below about 2,000° C. and a substantially transparent, polymeric spacer layer separating each metal layer from another metal layer, thereby causing portions of each metal layer to coalesce in response to the imagewise exposure by the laser, thus forming the image.

11 Claims, No Drawings

PROCESS OF FORMING AN IMAGE USING A MULTILAYER METAL COALESCENCE THERMAL RECORDING ELEMENT

FIELD OF THE INVENTION

This invention relates to a process of forming an image usig a thermal recording element comprising metal layers which coalesce.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet The thermal printing head has many heating elements and is heated up sequentially in response to one of the cyan, magenta or yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatization only in those areas in which its presence is required on the receiver to reconstruct the color of the original object. Further details of this process are found in GB 2,083,726A, the disclosure of which is hereby incorporated by reference.

DESCRIPTION OF RELATED ART

U.S. Pat. No. 4,394,661 relates to a thin metal film that will coalesce or "ball up" when heated rapidly with a high-intensity laser beam. This leads to a covering power change and an increased optical transmission. However, there is a problem with using such an element in that the optical density is not sufficient for many applications. If a thick metal film is employed in order to increase optical density, then the efficiency for coalescence decreases and the size of the debris created upon heating increases.

U.S. Pat. No. 4,650,742 relates to a method of using an optical recording medium having two metal layers sandwiching a sublimable organic layer. There is a problem with this method, however, in that removing the sublimable organic layer requires a material collection apparatus and may be environmentally detrimental.

U.S. Pat. No. 4,499,178 relates to a method of using an optical recording material where a heat insulating layer is interposed between a metallic recording layer and a reflecting layer. There is a problem with using this method in that the reflecting layer does not coalesce and therefore does not add to the image contrast It is an object of this invention to provide a method of forming an image wherein total optical density can be increased and the coalescence efficiency is improved, thus providing higher resolution using lower laser power. It is another object of the invention to provide a method of forming an image wherein a separate collection apparatus is not needed, and no material is ablated in the imaging process.

SUMMARY OF THE INVENTION

These and other objects are achieved in accordance with this invention which relates to a process of forming an image comprising imagewise-exposing, by means of a laser, a thermal recording element comprising a transparent support having thereon at least two metal layers having a melting point below about 2,000° C. and a substantially transparent, polymeric spacer layer separating each metal layer from another metal layer, thereby causing portions of each metal layer to coalesce in response to the imagewise exposure by the laser, thus forming the image.

It has been found that by separating a metal layer in a thermal recording element into multiple thin layers, the coalescence efficiency can be optiized while maintaining the total optical density. In addition, the size of the coalesced particles is minimized, thereby increasing resolution.

DESCRIPTION OF THE PREFERRED EMBODIMENTS

In the process of the invention, there are at least two metal layers in the thermal recording element and less than 30 such layers, but preferably 3 to 10 metal layers, each metal layer separated from the other by a substantially transparent polymeric spacer layer.

The thickness of the metal layer in the thermal recording element employed in the invention is generally such that the layer absorbs relatively strongly at the exposure, viewing, and masking wavelengths, but not so thick as to provide high reflectivity or poor melting characteristics when exposed. In general, the thickness of the layer is about 10 Å to about 5000 Å, preferably about 50 Å to about 500 Å.

The total optical density of the thermal recording element employed in the invention should be relatively high to provide good viewing contrast in applications, such as medical imaging and effective absorption in the UV/Visible region when used in masking applications, such as imagesetter films and integral printing plate applications. For example, each layer should have an optical density to UV, visible or near IR light above about 0.2 and below about 3.0, preferably above 0.5 and below 2.0. The total optical density of the thermal recording element is preferably greater than about 1.0 and less than about 6.0, preferably greater than 1.5 and less than 5.0.

Metals useful in the thermal recording element employed in the invention have a melting temperature below about 2000 ° C., preferably below 1500° C. Such metals include, for example, transition metals or a group III, group IV or group V metal. Such metals include titanium, chromium, iron, cobalt, nickel, copper, zinc, aluminum, tin, molybdenum, palladium, gold, silver, cadmium, tantalum, bismuth, tin oxide, indium tin oxide, platinum or mixtures or alloys thereof. In a preferred embodiment, the metal employed is nickel or platinum.

The substantially transparent, polymeric spacer layer used in the thermal recording element employed in the process of the invention is generally a material which does not readily sublime or produce excessive gaseous emissions under the exposure conditions. A low melting point is advantageous to allow the exposed areas to anneal and to prevent delamination of the layers. Suitable materials include poly(vinyl alcohol)s, fluoropolymers such as polytetrafluoroethylene, polylvinyl butyral)s, cellulosics, poly(methyl methacrylates), poly(methacrylic acid)s, polystyrenes, polyamides, polyethyleneoxides, poly(isobut methacrylate) s, and polyethylenes. The polymers may be crosslinked. In a preferred embodiment, the polymer is poly(vinyl alcohol) or polytetrafluoroethylene.

A protective layer consisting of a relatively thick transparent polymeric layer or layers may also be applied over the top metal layer in order to provide scratch-resistance. Suitable materials include polymers that can be the same or different from the polymeric material used for the spacer layers and include polymers from the same list of materials. The polymers in the protective layer may also be crosslinked. In a preferred embodiment, the protective layer is poly(vinyl butyral).

The protective layer may also contain transparent particles of organic or inorganic material, such as those disclosed in U.S. Pat. No. 4,772,582, in order to provide a matte appearance or to provide a gap in applications that require vacuum draw down. The particles can be entirely contained in the top layer or protrude from the top layer. Examples of such particles include fluoropolymers, polycarbonates, phenol resins, melamine resins, epoxy resins, silicone resins, polyethylene, polypropylene, polyesters, polyimides, etc; metal oxides; silicon oxides, titanium oxides; minerals; inorganic salts; organic pigments; and glasses etc.

The invention is especially useful in making high quality reproductions of film radiographs or for the production of digitally-captured diagnostic images. The accurate reproduction of copies of a film-based image or the quality of digitally-generated images is dependent upon the ability of the medium and technique to faithfully reproduce the gray-level gradation between the black and white extremes in the original image.

The invention also is usefl in making reprographic masks which are used in publishing and in the generation of printed circit boards. The masks are placed over a photosensitive material, such as a printing plate, and exposed to a light source. The photosensitive material usually is activated only by certain wavelengths. For example, the photosensitive material can be a polymer which is crosslinked or hardened upon exposure to ultraviolet or blue light, but is not affected by red or green light For these photosensitive materials, the mask, which is used to block light during exposure, must absorb all wavelengths which activate the photosensitive material in the Dmax regions and absorb little in the Dmin regions. For printing plates, it is therefore important that the mask have high blue and UV Dmax. If it does not do this, the printing plate would not be developable to give regions which take up ink and regions which do not By use of this invention, a mask can be obtained which has enhanced stability to light for making multiple printing plates or circuit boards without mask degradation. The process of the invention is well-suited for use with relatively inexpensive and reliable high power diode lasers or Nd++ YAG lasers and can be configured in either a flat bed, internal or external drum atiangement This also includes methods suited for imaging on a laser thermal imagesetter or platesetter equipment To obtain a laser-induced image according to the invention, an infrared diode laser is preferably employed since it offers substantial advantages in terms of its small size, low cost, stability, reliability, ruggedness, and ease of modulation.

Lasers which can be used in the invention are available commercially. There can be employed, for example, Laser Model SDL2420-H2 from Spectra Diode Labs, or Laser Model SLD 304 V/W from Sony Corp.

Any material can be used as the support for the recording element employed in the invention provided it is transparent, flexible, dimensionally stable and can withstand the heat of the laser. Such materials include polyesters such as poly (ethylene naphthalate); polysulfones; poly(ethylene terephthalate); polyamides; polycarbonates; cellulose esters such as cellulose acetate; fluorine polymers such as poly (vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; flexible metal sheets (which may also function additionally as the electrically conductive layer) such as aluminum, copper, tin, etc.; and polyimides such as polyimide-amides and polyether-imides. The support generally has a thickness of from about 5 to about 200 $\mu$m.

A thermal printer which uses a laser as described above to form an image on a thermal print medium is described and claimed in U.S. Pat. No. 5,168,288, the disclosure of which is hereby incorporated by reference.

The following examples are provided to illustrate the invention.

EXAMPLES

Example 1

A control element (C-1) comprising a single metal layer was prepared by sputter-coating a platinum target (from Radco Distributors) for 400 s onto a 7.6 cm by 7.6 cm support of 175 $\mu$m thick poly(ethylene terephthalate) using a Denton Vacuum Sputter coater (Model Desk II). The sample was then overcoated with a 5% solution of poly (vinyl alcohol) in water using a spin coater (Headway Research, Inc., Model 1PM101D-CB15) at 2000 revolutions per minute and dried.

A second control element (C-2) was prepared as above to aid in assessing reproducibility.

A four-layer platinum metal element according to the invention (E-1) was prepared using poly(vinyl alcohol) spacer layers. The element was prepared by sputter-coating a platinum target as above for 100 s onto a 7.6 cm by 7.6 cm support of 175 $\mu$m thick poly(ethylene terephthalate). The element was removed and coated with a 1% solution of poly(vinyl alcohol) in water using a spin-coater as above and dried. The element was placed back into the sputter-coater and the process repeated until four layers of platinum (100 s each) separated by poly(vinyl alcohol) spacer layers had been deposited. A final overcoat was added by spin-coating with a 5% solution of poly(vinyl alcohol) in water.

The above elements were then exposed in a thermal IR printer similar to the one described in U.S. Pat. No. 5,168, 288. The three elements were exposed using approximately 600 mW per channel, 9 channels per swath, 2400 lines per inch, a drum circumference of 53 cm and elliptical spots approximately 25 $\mu$m×12 $\mu$m at $1/e^2$ at the image plane. The test image consisted of 40 solid patches of uniformly decreasing laser intensity. Only the first few high-exposure patches impinged on the elements due to the limited sample size. Images were printed at 800 revolutions per minute. (The exposure levels do not necessarily correspond to the optimum exposure for these samples).

The ultraviolet density of the samples was measured in unexposed and exposed areas using an X-Ritem U transmission densitometer (X-Rite Corp., Model 361T). The following results were obtained:

TABLE 1

| Element | Layers of Platinum | Dmax | Dmin[1] |
|---|---|---|---|
| C-1 (control) | One | 3.14 | 0.41 |
| C-2 (control) | One | 3.52 | 0.50 |
| E-1 | Four | 4.34 | 0.09 |

[1]UV density measured at an exposure of 800 (mJ/cm$^2$)

The above results show the advantage of multiple metal layers compared to the controls which contain a single layer of approximately the same total optical density. Even with a slightly higher initial density, the four-layer platinum coating exhibited lower Dmin at a given exposure than did the single layer controls.

Example 2

A single nickel metal layer control with a poly(vinyl butyral) top coat (C-3) was prepared as follows by vacuum coating approximately 1200 Å of nickel onto a 15 cm by 23 cm area of 100 $\mu$m thick poly(ethylene terephthalate) by electron beam gun evaporation. The sample was then blade-coated with a 10% solution of poly(vinyl butyral) (Butvar® B-76, Monsanto) in ethyl acetate using a 25 $\mu$m knife.

A two-layer nickel sample with polytetrafluoroethylene (PTFE) spacer layers and poly(vinyl butyral) top coat (E-2) was prepared by first vacuum-coating approximately 600 Å nickel, using the method of C-3 above, followed by evaporation of 2000 Å of PTFE in a vacuum web coater. A second layer of approximately 600 Å nickel was coated. A top layer was blade coated with a 10% solution of poly(vinyl butyral) in ethyl acetate solution using a 25 $\mu$m knife.

Finally, a four-layer nickel sample with PTFE spacer layers and a poly(vinyl butyral) top coat (E-3) was prepared by first vacuum-coating approximately 300 Å nickel followed by using the vacuum web-coater of E-2 above and evaporating about 2000 Å of PTFE. A second layer of approximately 300 Å of nickel was applied followed again with 2000 Å of PTFE coated as above. The processes were repeated until four layers of nickel each separated by PTFE were obtained. The sample was then blade-coated with a 10% solution of poly(vinyl butyral) in ethyl acetate solution using a 25 $\mu$m knife.

The samples were exposed as above but at 500 and 1000 revolutions per min. The ultraviolet density of the samples was measured in unexposed and exposed areas using an X-Rite® UV transmission densitometer (model 361T). Speed points were taken to be the exposure at 0.30 o.d. above Dmin. A lower speed point value is desirable since it means that less energy is required to properly expose the thermal imaging element. Higher Dmax and lower Dmin are desirable since this provides higher image contrast. The following results were obtained:

TABLE 2

| Element | Layers of Nickel | Dmax (o.d.) | Dmin[1] (o.d.) | Speed[2] (mJ/cm$^2$) | Dmin[3] (o.d.) | Speed[4] (mJ/cm$^2$) |
|---|---|---|---|---|---|---|
| C-3 (control) | One | 2.46 | 0.13 | 1160 | 0.35 | 635 |
| E-2 | Two | 3.05 | 0.07 | 920 | 0.18 | 625 |
| E-3 | Four | 2.80 | 0.21 | <740[5] | 0.23 | 480 |

[1]UV density measured for an exposure of 1340 (mJ/cm$^2$) corresponding to 500 rev/min writing speed.
[2]Speed point taken to be exposure at 0.30 o.d. above Dmin measured at 500 rev/min.
[3]UV density measured for an exposure of 643 (mJ/cm$^2$) corresponding to 1000 rev/min writing speed.
[4]Speed point taken to be exposure at 0.30 o.d. above Dmin measured at 1000 rev/min.
[5]Estimated because the exposure series exceeded the physical dimensions of the sample.

The above results demonstrate the advantage of multiple metal layers compared to a single layer control of approximately the same total optical density. The two-layer nickel coating exhibited lower Dmin at the given exposure levels even with a slightly higher initial density relative to the control. The four-layer nickel coating exhibited lower Dmin at 1000 revolutions per minute than the control and was the most sensitive film overall, requiring the least exposure to achieve a transmission of 0.3 o.d. above Dmin (designated as speed point).

The invention has been described in detail with particular reference to preferred embodiments thereof, but it will be understood that variations and modifications can be effected within the spirit and scope of the invention.

What is claimed is:

1. A process of forming an image comprising imagewise-exposing, by means of a laser, a thermal recording element comprising a transparent support having thereon at least two metal layers having a melting point below about 2,000° C. and a substantially tnmsparent, polymeric spacer layer separating each said metal layer from another metal layer, thereby causing portions of each said metal layer to coalesce in response to said imagewise exposure by said laser, thus forming said image.

2. The process of claim 1 wherein said metal layer comprises a transition metal or a group III, group IV or group V metal.

3. The process of claim 1 wherein each said metal layer has an optical density to UV, visible or near IR light above about 0.2 and below about 3.0, and wherein the total optical density of the thermal recording element is greater than about 1.0 and less than about 6.0.

4. The process of claim 1 wherein each said metal layer is platinum.

5. The process of claim 1 wherein each said metal layer is nickel.

6. The process of claim 1 wherein said polymeric spacer layer is poly(vinyl alcohol).

7. The process of claim 1 wherein said polymeric spacer layer is polytetrafluoroethylene.

8. The process of claim 1 wherein the outermost metal layer is overcoated with a polymeric overcoat layer.

9. The process of claim 8 wherein said polymeric overcoat layer is poly(vinyl butyral).

10. The process of claim 8 wherein said polymeric overcoat layer contains particles to provide a matte surface.

11. The process of claim 1 wherein the thermal recording element contains 3 to 10 metal layers.

* * * * *